US012465107B2

(12) United States Patent
Syphrit

(10) Patent No.: US 12,465,107 B2
(45) Date of Patent: Nov. 11, 2025

(54) WEARABLE ARTICLE AND SYSTEM FOR SECURING ARTICLE TO THE BODY

(71) Applicant: Michael J. Syphrit, Pompano Beach, FL (US)

(72) Inventor: Michael J. Syphrit, Pompano Beach, FL (US)

( * ) Notice: Subject to any disclaimer, the term of this patent is extended or adjusted under 35 U.S.C. 154(b) by 250 days.

(21) Appl. No.: 18/229,567

(22) Filed: Aug. 2, 2023

(65) Prior Publication Data

US 2025/0040649 A1 Feb. 6, 2025

(51) Int. Cl.
*A42B 1/14* (2006.01)
*A42B 7/00* (2006.01)

(52) U.S. Cl.
CPC . *A42B 7/00* (2013.01); *A42B 1/14* (2013.01)

(58) Field of Classification Search
CPC ..... A42B 7/00; A42B 1/14
See application file for complete search history.

(56) References Cited

U.S. PATENT DOCUMENTS 585,062 A * 6/1897 Tucker ..... A42B 7/00 132/69.1
626,416 A * 6/1899 Fitzgerald ..... A42B 7/00 2/175.7
791,505 A * 6/1905 Runkel ..... A42B 7/00 132/60
1,894,213 A 1/1933 Ostolaza
2,686,917 A * 8/1954 Auerbach ..... A42B 1/0186 2/172
3,898,699 A 8/1975 Zientara et al.
4,011,600 A 3/1977 Malk
4,683,596 A 8/1987 Cole
5,802,617 A 9/1998 Boden
6,345,395 B1 2/2002 Chilton
6,748,606 B1 6/2004 Silverstein
7,926,121 B2 4/2011 Syphrit
2008/0052805 A1* 3/2008 Syphrit ..... A42B 1/22 2/183
2015/0135412 A1* 5/2015 Shefner ..... A42B 1/08 2/413
2018/0140033 A1* 5/2018 Thornton ..... A42B 1/0182
2020/0214382 A1* 7/2020 Dann ..... A42B 1/225
2020/0253317 A1* 8/2020 Niedermeyer ..... A42B 7/00
2025/0040649 A1* 2/2025 Syphrit ..... A42B 7/00

* cited by examiner

*Primary Examiner* — Khaled Annis
(74) *Attorney, Agent, or Firm* — Ted Whitlock; 500Law

(57) ABSTRACT

A system for providing a drawstring for an article of clothing or accessory having a front and a back and having a peripheral surface necessary to be tightened, the system including a semi-rigid weave layer having a braided strands of a fibrous material defining a pattern in the article having openings which repeat at a number in a range of about 3 to about 8 per linear inch in all directions, and in which the openings of the layer define a range of between about 15 to about 35 percent of the entire surface of the weave layer and a cord braided of filaments of a material more pliable than the braided strands of the weave layer.

19 Claims, 7 Drawing Sheets

WEARABLE ARTICLE AND SYSTEM FOR SECURING ARTICLE TO THE BODY

BACKGROUND OF THE INVENTION

Hats that have a means for adjusting size and tightness of fit for the wearer are known. Adjustable straps or adjustable sweatbands or headbands forming part of the hat, and adjustable inner circumference hats are some of the adjustment means that have been employed in the past. Other prior means for adjusting the size of a hat have included a cord, such as an elongated flexible plastic tube, with a portion extending across the interior of the hat between opposite sides of a lower portion of the crown, at a location to contact the user's forehead and to position the hat relative thereto.

In U.S. Pat. No. 7,926,121, incorporated herein by reference in its entirety, this inventor describes hat having a drawstring for adjusting size and securing the hat by tightening the drawstring, wherein the hat is ventilate, simple to adjust, and free from any type of sweatband which contacts the head of the wearer. While this invention was a significant departure and improvement over prior means of adjusting the size and fit of a hat, maintaining tension of the adjusting cord for periods of time greater than about 30 minutes, proved elusive. The hat described in the '121 patent provided two openings in the front of the hat and two openings in the back of the hat, through which the drawstring was woven.

A hat or other headwear having a drawstring or cord that can be tightened to provide pressure evenly around the head of the wearer, providing stable, long-term (greater than 30 minutes, and preferably about one hour to about four hours) tension of the drawstring or cord while being worn, can provide the wearer a stronger sense of security that the headwear remains in place in a comfortable and secure position for an extended period of time, even in windy conditions, has long been a desired goal.

The present invention addresses this long-felt need for a wearable article, such as a hat, and a system for securing headwear that remains in place in a comfortable and secure position for an extended period of time.

SUMMARY OF THE INVENTION

The subject invention concerns a wearable article, e.g., an article of clothing, preferably headwear, such as a hat or cap, that is free of an inner headband or sweatband, and a system for securing the article to the body, comprising an adjustable and securable drawstring or cord configured to maintain its securely adjusted position and placement for a greater period of time compared to similar headwear that does not include the drawstring or cord configured in the same way. This invention includes a system which comprises an article of clothing or accessory and a cord serving as a drawstring to adjust, tighten, or secure the article of clothing or accessory. A method of using the article of clothing or accessory as described herein also forms part of the invention.

Generally, the subject invention concerns an open-weaved article of clothing or accessory comprising, for example, a weave layer forming the body of the article, wherein the article needs to be tightened around its periphery to secure it in place in relation to the body of the wearer. The invention is particularly applicable to headwear, such as a hat or cap, especially a hat or cap that does not include a headband or sweatband on its inner surface, or which does not include a chinstrap for securing the hat or cap to the head of the wearer.

The subject invention concerns a system for tightening an article of clothing or accessory having a front and a back and having a peripheral surface capable of being size-adjusted or tightened onto a body of a wearer, said system comprising: (a) the article of clothing or accessory comprising a plurality of braided strands of a fibrous material forming a semi-rigid weave layer having pattern of about 3 to about 8 holes or openings per linear inch in all directions such that the holes or openings form between about 15 to about 35 percent of the entire surface of said weave layer; and (b) a braided cord more pliable than said weave layer and comprising a plurality of filaments. The drawstring or cord has a first end, a second end, and a middle segment adjoining the first and second ends.

The cord can be press-fittingly woven through two front openings in the weave layer. These two front openings are positioned at the front of the article of clothing or accessory, about one inch to about two inches apart from one another on a horizontal plane, and on opposing sides of an axial midline forming right and left halves of the article of clothing or accessory.

About one inch of the middle segment of the cord is positioned on an inner surface of the weave layer, leaving a remaining length of the drawstring or cord, including the first and second ends, positioned outwardly, and on the outer surface of the weave layer as it extends on opposite left and right sides and toward the back of the article of clothing or accessory.

At the back of the article of clothing or accessory, the first end of the drawstring or cord is press-fittingly inserted into and out of each of four back openings in the weave layer, and the second end of the drawstring or cord is press-fittingly woven through at least two of the four back openings in the weave layer.

The first and second ends of the drawstring or cord are woven through the back openings in opposite directions, whereby the first and second ends of the drawstring or cord, and the sub-segments of the drawstring or cord adjoining each of the first and second ends extend outwardly from the outer surface of the weave layer, such that the adjoining sub-segments have sufficient length to allow them to be manually grasped to tighten the drawstring or cord and secure the article of clothing or accessory to the body of the wearer.

The four back openings are positioned substantially along a horizontal plane parallel to the front two openings, whereby one or more sub-segments adjoining the first end of the cord frictionally contact one or more sub-segments adjoining the second end of the drawstring or cord.

The system can preferably include an article of clothing or accessory which is a hat, having a drawstring or cord which is tightened to secure the article to the head of the wearer.

In one embodiment, both the first and second ends of the drawstring or cord are press-fittingly woven through all four back openings.

The weave layer of the article of clothing or accessory can be formed from a sea grass or can be a polymeric material. The weave layer is preferably provided such that plurality of openings are formed in the weave layer in a repeating pattern from about 3 to about 5 times per linear inch in all directions.

The drawstring or cord can comprise braided material, such as a macrame fabric.

The subject invention can also include an article of clothing or accessory comprising the features of the system, described hereinabove. A preferred article of clothing or accessory of the invention is a hat. More preferably, the article of clothing or accessory of the invention is a hat which excludes, or is free of, a headband or sweatband disposed on an inner surface of the hat.

A preferred hat of the invention is ventilate, being formed from a weave layer providing openings in a repeating pattern from about 3 to about 5 times per linear inch in all directions. In one preferred embodiment, the hat comprises two front openings and four back openings through which a drawstring or cord can be woven. More preferably, a first end of the drawstring or cord is woven through the front two openings, and centered such that the remaining sub-segments of the drawstring or cord are approximately the same length.

At least one of the first and second ends is woven through all four back openings. The other of the first and second ends is woven through at least two of the four back openings. In a preferred embodiment, both the first and second ends are woven through all four of the four back openings.

One preferred method of assembling an article of clothing or accessory and drawstring or cord in accordance with the invention, e.g., a hat and cord, comprises press-fittingly weaving only a first end of the drawstring or cord sequentially through all openings. Starting at, for example, the outermost right back opening, the first end of the cord is press-fittingly woven into this right-back opening, out from the center-right back opening, into the center-left back opening and out from the outermost left back opening, leaving the second end and a sub-segment contiguous with the second end extending from the outermost right back opening.

The cord is then extended to the front of the hat along the base of the crown on the left side (right and left sides, as viewed from the top), and press-fittingly woven into the left front opening and out from the right front opening. The first end is then extended to the back of the hat along the base of the crown on the right side, and press-fittingly woven through the four back openings in the same direction and pattern—into the right-outermost back opening; out the center-right back opening; into the center-left back opening; and out the left outermost back opening, leaving a sub-segment contiguous with the first end extending from the outermost left back opening.

Preferably, the sub-segments contiguous with the respective first and second ends are approximately equal in length when in their final press-fitted woven position, and extend from the body of the hat to provide lengths that are sufficient for easily grasping and tightening the cord around the periphery of the hat by the wearer. In this configuration, wherein the cord overlaps with itself at each of the four back openings, and between the two right openings and the two left openings, the frictional contact of the subsegments of the cord advantageously maintains the cord in a secure and stable position when tightened, without a separate or discrete securing means affixed to the cord.

The article of clothing or accessory of the invention can comprise a macrame or crochet weave layer shaped to form the body of the hat, namely the crown and brim of the hat. A woven dried sea grass material or polymeric material can be used to make the weave layer. For example, the weave material can comprise a plurality of braided strands of a fibrous material forming a semi-rigid weave layer having pattern of about 3 to about 8 openings per linear inch in all directions, such that the openings account for about 15 to about 35 percent of the entire surface of the weave layer.

The subject invention also includes a method for tightening and securing an article of clothing or accessory, such as a hat described herein, to a body of a wearer. The method of the invention comprises the steps of:

providing an article of clothing or accessory as described herein, manually pulling a segment of the cord adjoining a first end of the cord, and concurrently or simultaneously pulling a segment adjoining the second end of the cord thereby tightening the cord around the body of the wearer and securing the article to the body of the wearer.

Preferably, the method employs a hat having a drawstring or cord, as described herein, whereby the hat is tightened and secured onto the head of the wearer.

It is an object of the invention to provide an efficient system for adjusting, tightening, fastening, or securing, a drawstring provided with an article of clothing or accessory.

It is another object to provide a system which can adjustably secure an article of clothing or accessory such as a hat without need for any fastening means other than a drawstring.

It is yet another object of the invention to provide a system which securely fastens an article of clothing or accessory such as a hat without need for any fastening means other than a drawstring, and where the drawstring is not required to be tied into a bow or a knot and does not require a catch or locking device to secure the drawstring or cord in a desirable position.

The above and other objects and advantages of the present invention will become apparent from the description provided in this specification, including the drawings and claims.

DETAILED DESCRIPTION OF THE INVENTION

Figure 1:
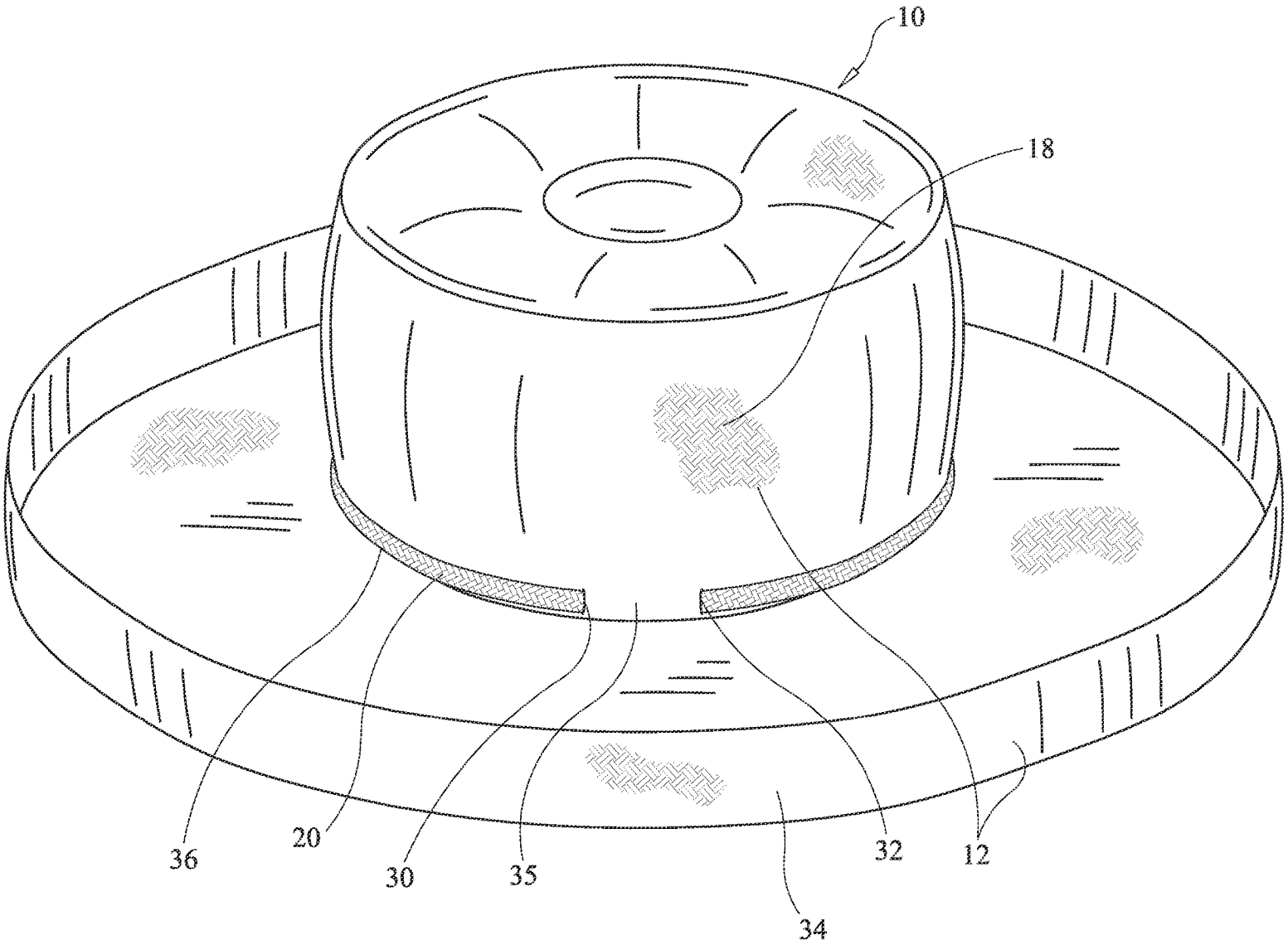
FIG. 1 is a front perspective view of the article.

The term "macrame," as used herein, means a course lace or fringe made by knotting threads or cords in a geometrical pattern and, at times, also refers to the art of tying knots in patterns.

The term "weave," as used herein, means needlework consisting of the interlocking of looped stitches formed with a single thread and a hooked needle. The term "weave" can include the term "crochet", which refers to a braided or spun material such as yarn is made up into a patterned fabric by looping yarn with a hooked needle.

The terms "drawstring" and "cord" refer to the same element described for the invention and can be, and are, used interchangeably herein.

In accordance with the subject invention, an article of clothing or accessory, such as a hat made of a flexible material, includes a lateral peripheral surface, a transverse plane of which must be tightened in order to secure the article of clothing to a part of the human body such as the head. More particularly, such an article of clothing may include a hat having a drawstring or cord which encircles the crown of the hat, wherein the drawstring or cord is woven in and out of the flexible hat material in such a way as to allow the drawstring to be manually tightened to efficiently secure the hat to the head of the wearer.

One embodiment of an article and system of the invention comprises a hat that is woven (e.g., crochet, knit, macrame, weave, or the like) from a plurality of braided strands of a fibrous material forming a semi-rigid weave layer, wherein the weave provides a plurality of ventilate openings in a repeating pattern in all directions. The number of openings in the weave layer can range from about 3 to about 8 per linear inch, and wherein the openings define about 15 to about 35 percent of the entire surface of said weave layer. Accordingly, the braided strands bounding the openings define about 65 to about 85 percent of the entire surface.

In an embodiment comprising a hat or cap, the weave layer can be shaped to provide a domed or crown portion and a brim portion of the hat, wherein the shaped weave layer forms an inner surface, which faces the wearer when in use, and an outer surface, which faces away from the wearer when in use. The brim portion can extend completely or partially around the crown portion.

Although the crown portion and brim portion can vary in geometrical shape, and can be triangular, square, rectangular, or polygonal, a preferred embodiment of a hat or cap according to the invention is substantially circular and therefore uniform as viewed from any angle. The placement of a drawstring or cord (described below) around the circumference of the crown portion can define a front, back, top, bottom, and left and right sides of the article. The front of the article of the invention comprises two openings in the weave layer through which the drawstring or cord is press-fittingly woven, and the back of the article comprises at least four openings in the weave layer, wherein at least one end of the drawstring or cord is press-fittingly woven through all four back openings.

The article and system of the invention also comprises a braided drawstring or cord formed from a plurality of filaments. The material forming the drawstring or cord is preferably more pliable than the fibrous material that forms the weave layer. The drawstring or cord is of a finite length, having a first end, a second end, and a middle portion adjoining the first and second ends, forming a length of the drawstring or cord. The drawstring or cord is proportioned to have sufficient length such that the drawstring or cord can at least encircle the circumference of the crown portion of the article with additional length ("sub-segments" of the middle portion of the drawstring or cord) provided to extend from the back openings in the crown and be easily grasped for adjusting or tightening of the drawstring. The length of the drawstring or cord is also sufficient to allow weaving of the drawstring or cord into and out of the weave layer, and such that both the first and second ends extend from the back openings of the weave layer for grasping, adjusting, or tightening to secure the article in place when worn.

The pliability of the drawstring or cord provides for its press-fittable insertion and weaving through openings in the weave layer and retaining the drawstring or cord in position relative to the wearable article. The drawstring or cord is press-fittingly inserted or woven through two openings in the weave layer at the front of the article such that a central sub-segment of the middle portion of the drawstring or cord is positioned at the front of the article, on the inner surface of the article. These two front openings in the weave layer are positioned in proximity to one another, forming a front-right opening and a front-left opening, relative to a central axial plane (the right/left midline) of the article when viewed from the top. The two front openings are preferably about one inch to about two inches apart from one another on the front of the article, preferably equidistant from the right/left midline of the article. This configuration for placement of the drawstring or cord at the front of the article results in about one to two inches of the drawstring or cord being exposed on the inner surface of the weave layer.

The remaining lengths or sub-segments of the middle portion of the drawstring or cord extend from the front two openings, along an outer surface of the weave layer on both opposing right and left sides of the article, to the back of the article. The first end of the drawstring can be referred to as the right drawstring which extends along a right side of the crown of the article, and the second end of the drawstring can be referred to as the left drawstring extending along the left side of the crown of the article.

The article of clothing or accessory also includes four openings disposed on the back side, where each of the first and second ends of the drawstring or cord is press-fittingly woven into and out of at least two, and preferably four, of the back openings formed in the weave layer. These back openings serve to retain the drawstring or cord in position and result in sub-segments upstream from each of the first and second ends to frictionally contact one another and therefore keep them in position when adjusted or tightened and retain the adjusted or tightened position of the drawstring or cord. The four openings in the back of the article are in proximity to one another, configured to be about at least one-half inch, and up to about four inches (preferably about three inches) apart from each other.

In one preferred embodiment, the four openings in the weave layer at the back of the article form one back-left opening, one back-left-center opening, one back-right-center opening, and one back-right opening. These openings can be evenly spaced apart or unevenly spaced apart, but preferably form two back openings on the left side and two back openings on the right side of the article, the two pairs of back openings being positioned approximately equidistant from the right/left midline of the article. For example, an uneven spacing of the back openings can comprise a back-left opening spaced about one to two inches from the central axial plane (the central axial plane being that which divides the article into right and left halves), a back-left-center opening spaced about one-half inch from the back-left opening, toward the central axial plane relative to the back-left opening. The back-right-center and back-right openings are positioned wherein the back-right opening is spaced about one to two inches from the central axial plane, and the back-right-center opening spaced about one-half inch from the back-left opening, toward the central axial plane.

In this configuration, a back-left-center opening can be positioned about one to two inches from the back-right-center opening. The back-left opening can be positioned about one-half inch from the back-left-center opening and the back-right opening can be positioned about one-half inch from the back-right-center opening. Thus, there are two openings about a half-inch apart on the left side of the article, relative to the right/left midline, and two openings about a half-inch apart on the right side of the article, relative to the right/left midline of the article. This configuration places the back-left opening about two to four inches from the back-right opening, and the back-left-center opening about one to three inches from the back-right-center opening.

Preferably, the back-right and back-right-center openings receive the first end of the drawstring or cord extending from a front opening on the same side of the article (the right side, as viewed from the top), and the back-left and back-left-center openings receive the second end of the drawstring or cord extending from the other front opening (the left front opening, as viewed from the top.) Press-fitting each of the drawstring or cord ends into back openings from opposite directions where the first and second ends extend outwardly therefrom, on the outer surface of the article, causes segments of the drawstring or cord, just upstream from the first and second ends, to frictionally contact one another and to frictionally contact the back openings of the weave layer, which can facilitate securing of the drawstring or cord in a tightened position for extended periods of time.

The front and back openings for receiving and retaining the drawstring or cord are preferably positioned in substantially the same plane relative to the top and bottom of the article, such that the drawstring or cord tightens around the outer circumference of the article at the base of the crown—the base of the crown being the transitional juncture of the crown portion with the brim portion. Sub-segments of the middle portion of the drawstring or cord extend outwardly from the back openings in the weave layer, permitting manual engagement of those extending sub-segments of the drawstring or cord for purposes of tightening the drawstring or cord around the periphery of the article and to secure the article to the head of a wearer.

An article of clothing or accessory, such as a hat, in accordance with the invention, preferably excludes a headband or sweatband disposed on an inner surface of the hat. Therefore, an article of clothing or accessory in accordance with the invention can be a system comprising a drawstring or cord for tightening and securing the article, and weave layer forming a crown and brim of a hat, without, or free of, a headband or sweatband. Alternatively, an article of clothing or accessory of the invention can consist of a weave layer forming a crown and brim of a hat having two front openings and four back openings, and a peripheral drawstring or cord for tightening and securing the article. The invention can also include an article of clothing or accessory comprising a drawstring or cord for tightening and securing the article, and a weave layer forming a crown and brim of a hat, without, or free of, a headband or sweatband, or can be an article of clothing or accessory consisting of a drawstring or cord for tightening and securing the article, and a weave layer forming a crown and brim of a hat.

To illustrate the invention, reference is made to the appended drawings, showing a hat and drawstring configuration. FIG. 1 shows hat 10 made of a semi-rigid weave or crochet layer 12 which comprises a plurality of fibrous filaments braided into individual strands. As further illustrated in FIG. 1, these strands can be woven or crocheted to define a pattern which may be a pattern having many openings 18. In order words, said semi-rigid weave layer 12 defines a plurality of openings 18 which repeat at a number in a range of about three to about eight per linear inch with a preferred range being that of about three to about five per linear inch, this extending in all directions from a given opening 18.

The weaving of said weave layer 12 is typically such that said openings 18 defines about 15 to about 35 percent of the entire surface of the weave layer 12. While the use of straw represents the preferred embodiment for said weave layer, other materials, e.g., polymers having similar properties of flexibility and surface friction may also be employed. Tightening of the weave layer in a peripheral surface intended to enclose a part of the human body is accomplished through the use of a drawstring or cord 20, which is preferably formed of a plurality of filaments. Said cord 20 may be formed of filaments, preferably by braiding. Further, the material of said filaments preferably comprises a material more pliable than that of said braided filaments of the weave layer 12.

Figure 2A:
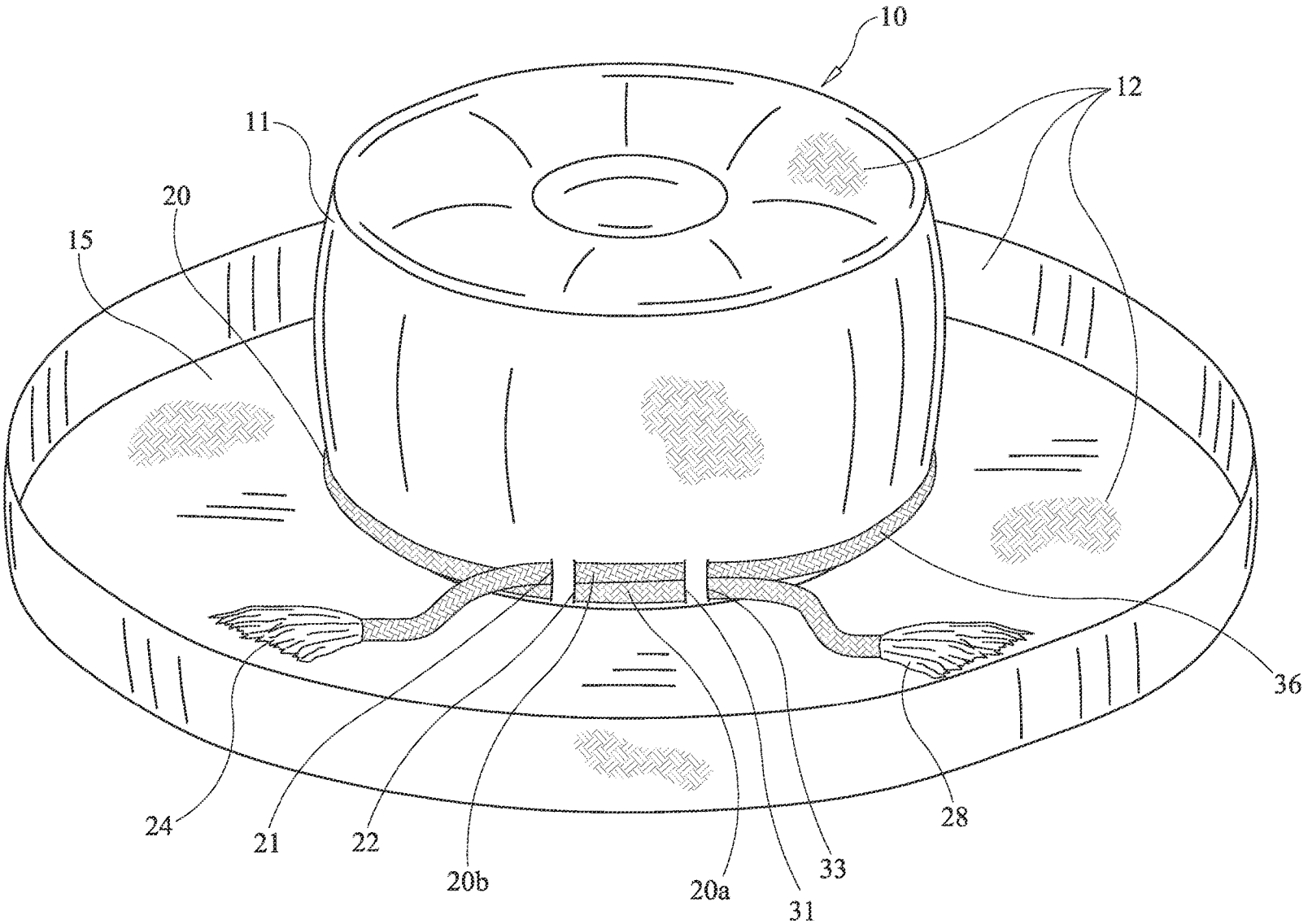
FIG. 2A is a back perspective view of the article illustrating the first and second ends of a drawstring woven through all four back openings.
Figure 2B:
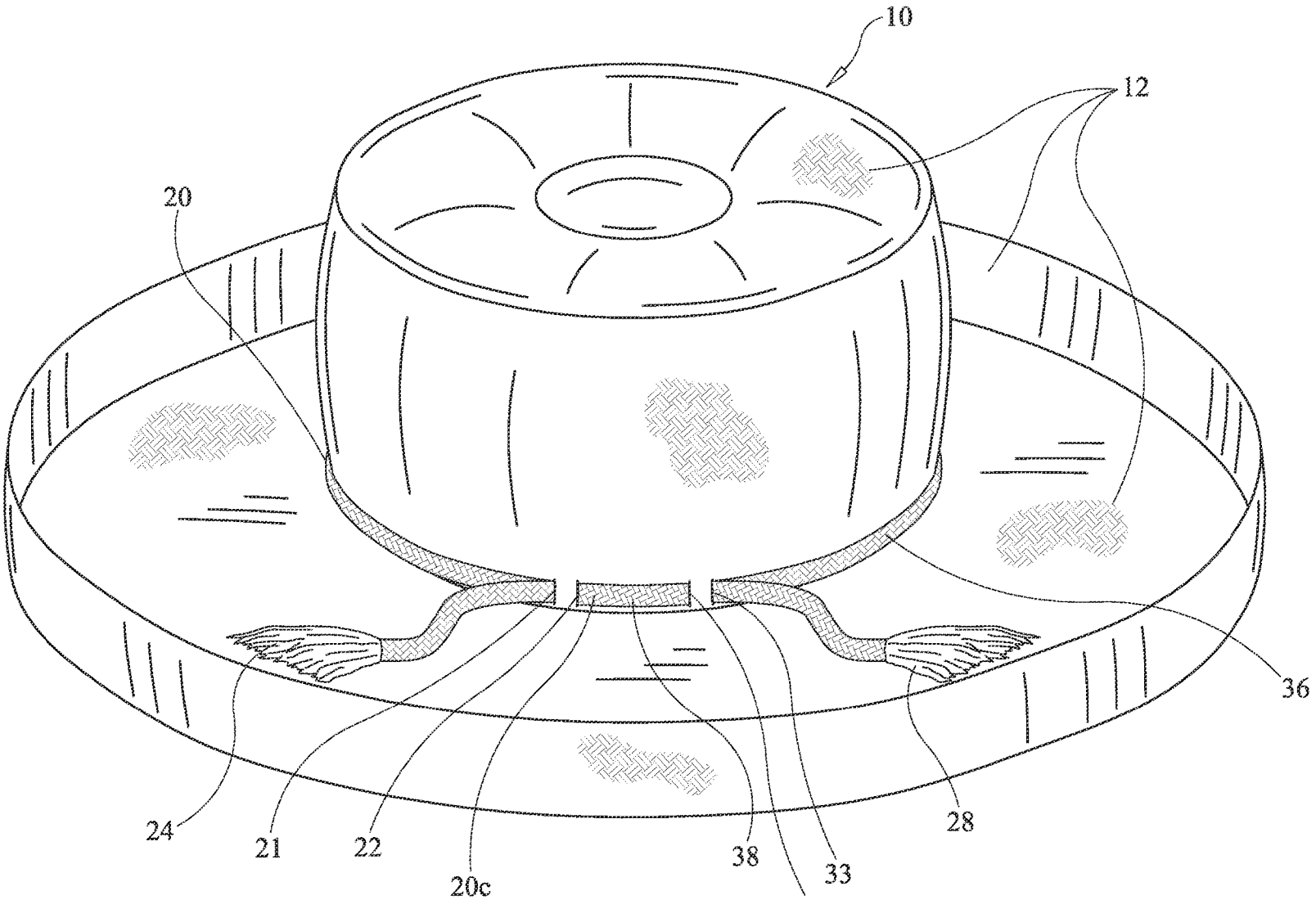
FIG. 2B is a back perspective view of the article illustrating one of a first end and second end of the drawstring woven through all four back openings, and the other of a first end and a second end of the drawstring woven through two of the four back openings.

As can be seen in FIGS. 2A and 2B, cord 20 includes a first end 24 and a second end 28. First and second ends 24 and 28 of cord 20 are contiguous, and therefore include a middle portion which adjoins the first and second ends. FIG. 1 shows that cord 20 is proportioned for press-fittable insertion between two front openings 30 and 32 in the weave layer 12 at a front 34 of the weave layer 12. Openings 30 and 32 in the weave layer can be up to about two inches apart from one another, but are preferably about one-inch apart from one another—one opening on either side of an axial midline of hat 10, wherein the axial midline defines a right and left half of hat 10.

Cord 20 can be inserted into weave layer 12 using a needle, awl, or like instrument having a tapered or pointed end. As such, about a one-inch length of cord 20 is positioned inwardly of the weave layer, that is, exposed on an inner face of the hat, proximate to the head or body of the user, leaving gap 35 on a front side of hat 10, behind which the middle portion of cord 20 is positioned.

A remaining peripheral length of said cord 36 is positioned outwardly of said layer and extends on both left and right sides of hat 10 to a back side of hat 10. FIGS. 2A and 2B show a back perspective view of hat 10, illustrating a four-opening configuration for receiving cord ends 24 and 28 such that cord 20 is woven through these four openings on the back side of the hat. FIG. 2A shows a four-opening configuration, illustrating (as viewed from this angle, or from a top view) back-left opening 21, back-left-center opening 22, back-right-center opening 31, and back-right opening 33. Back-left-center opening 22 and back-right-center opening are preferably about one inch apart. Front and back openings occupy an imaginary plane in said peripheral surface which the present system provides tightening about, said plane oriented approximately parallel to the juncture of the crown portion 11 and brim portion 15 of hat 10.

In one preferred embodiment illustrated in FIG. 2A, first end 24 of cord 20 is woven through each of said back openings 21, 22, 31, and 33. Specifically, first end 24 of cord 20 is press-fitted into and through back-right opening 33, into the inner surface of hat 10, then press-fitted out of and through back-right-center opening 31, extended across an axial midline and press-fitted into back-left-center opening 22 (to the inner surface of hat 10), then press-fitted through and out of back-left opening 21, whereby a sub-segment of cord 20 and first end 24 extend to an outer surface of hat 10 and provide a length which can be grasped and adjusted or tightened by a wearer.

Similarly, FIG. 2A illustrates second end 28 of cord 20 woven through each of said back openings 21, 22, 31, and 33 in an opposite direction from first end 24. Specifically, second end 28 of cord 20 is press-fitted into and through back-left opening 21, into the inner surface of hat 10, then press-fitted out of and through back-left-center opening 22, extended across an axial midline and press-fitted into back-right-center opening 31 (to the inner surface of hat 10), then press-fitted through and out of back-right opening 33, whereby a sub-segment of cord 20 and second end 28 extend to an outer surface of hat 10 and provide a length of cord 20 which can be grasped and adjusted or tightened by a wearer.

This pattern of press-fitting the cord 20 described above, where each of first and second ends 24 and 28 of cord 20 are woven through each of the four back openings provides two overlapping sub-segments 20*a* and 20*b* of cord 20, in frictional contact with one another. The cord also overlaps with itself and is in frictional contact at each of back openings 21, 22, 31, and 33.

One preferred method of assembling an article of clothing or accessory and drawstring or cord e.g., a hat and cord illustrated in FIGS. 1 and 2A, comprises press-fittingly weaving only a first end 24 of cord 20 sequentially through all openings. Starting at, for example, the outermost right back opening 33, the first end of the cord is press-fittingly woven into right-back opening 33, out from the center-right back opening 31, into the center-left back opening 22 and out from the outermost left back opening 21, leaving the second end 28 and a sub-segment contiguous with the second end extending from the outermost right back opening 33.

The first end 24 of cord 20 is then extended to the front of the hat along the base of the crown 11 on the left side (left side, as viewed from the top or back) to the front of hat 10. Referring back to FIG. 1, wherein right and left sides are oriented as looking straight into the page, first end 24 of cord 20 is press-fittingly woven into the right front opening 32 and out from the left front opening 30. The first end 24 is then extended to the back of the hat along the base of the crown on the right side (right side, as viewed from the top or from the back as in FIG. 2A), and press-fittingly woven through the four back openings in the same direction and pattern-into the right-outermost back opening 33; out the center-right back opening 31; into the center-left back opening 22; and out the left outermost back opening 21, leaving a sub-segment contiguous with the first end 24 extending from the outermost left back opening 24.

Figure 3A:
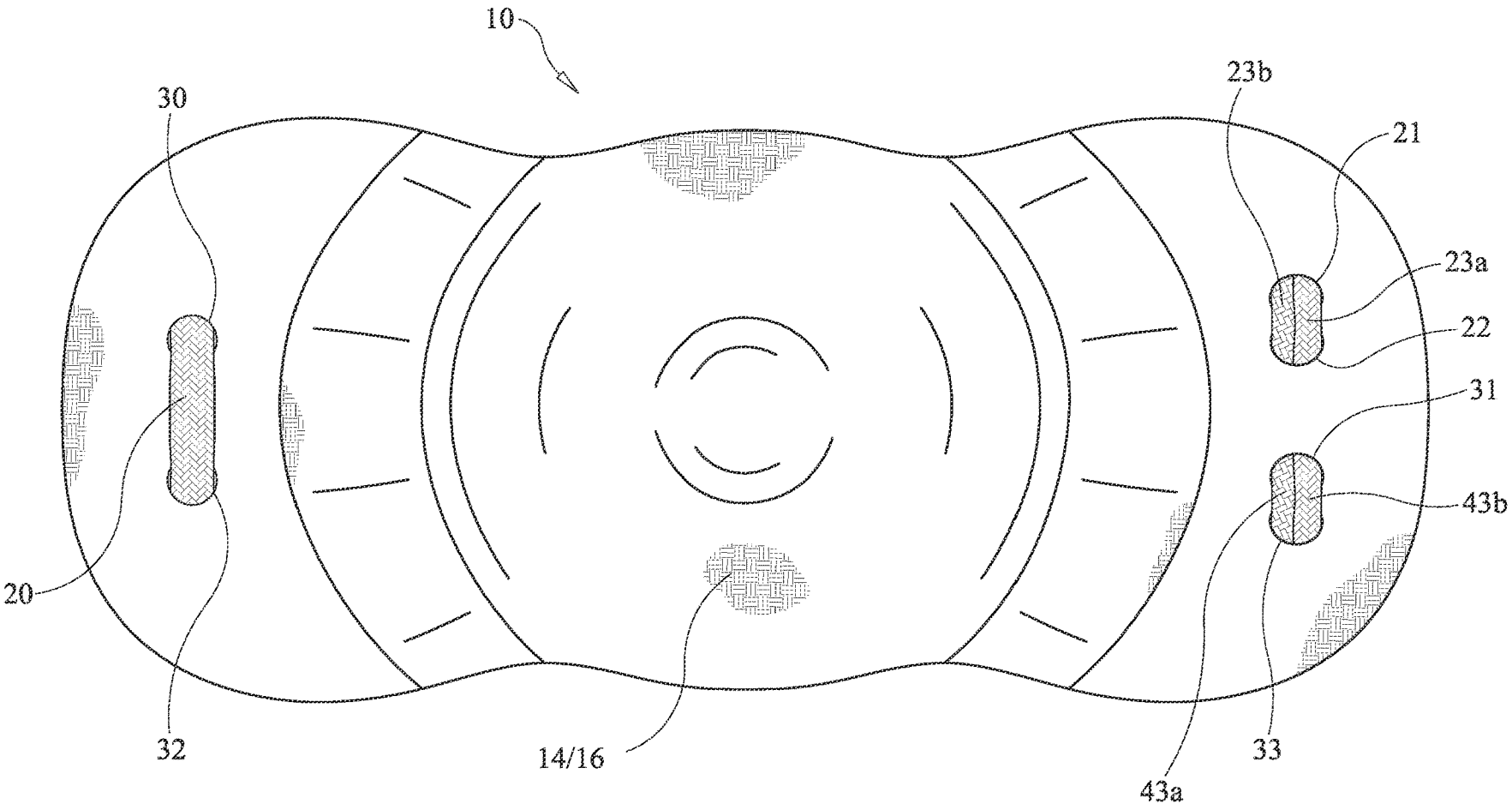
FIG. 3A is a bottom view of the article illustrated in FIG. 2A having the first and second ends of the drawstring woven through all four back openings.

Preferably, the sub-segments contiguous with the respective first and second ends 24 and 28 are approximately equal in length when in final position and extend from the body of the hat and have lengths sufficient to be easily grasped for tightening the cord around the periphery of the hat by the wearer. In this configuration, cord 20 overlaps with itself at each of the four back openings. As illustrated in FIG. 3A, sub-segments 23*a* and 23*b* overlap and frictionally contact one another between openings 21 and 22, and sub-segments 43*a* and 43*b* overlap and frictionally contact one another between openings 31 and 33. The frictional contact of cord 20 with itself, and the frictional contact of subsegments 23*a* and 23*b*, as well as 43*a* and 43*b*, advantageously maintains the cord in a secure and stable position when tightened, without a separate or discrete securing means affixed to cord 20 or any sub-segment thereof.

The press fitted weave configuration of first and second ends 24 and 28 of the cord 20 can be varied, for example, in one embodiment according to the invention, one of such first or second ends 24 and 28 can be woven through only two of the four back openings. This cord weave configuration is illustrated in FIG. 2B. One of the first end 24 or second end 28 is woven through two of the four back openings, and the other of the first end 24 or second end 28 is woven through all four of the four back openings. Described here is a configuration where first end 24 is woven through two of the four back openings and second end 28 is woven through all four back openings, but it would be understood that first end 24 can be woven through each of the four back openings 21, 22, 31, and 33, and second end 28 can be woven through two of the four back openings.

Referring to FIG. 28, the first end 24 of cord 20 is woven through back openings 21 and 33. Specifically, first end 24 of cord 20 is press-fitted into and through back-right opening 33, into the inner surface of hat 10, then extended across an axial midline on an inner surface of hat 10, and press-fitted out of and through back-left opening 21, to extend to an outer surface of hat 10 and provide a length of cord 20 which can be grasped and adjusted or tightened by a wearer. FIG. 2B further illustrates second end 28 of cord 20 woven through each of said back openings 21, 22, 31, and 33. Specifically, second end 28 of cord 20 is press-fitted into and through back-left opening 21, into the inner surface of hat 10, then press-fitted out of and through back-left-center opening 22, extended across an axial midline on an outer surface of hat 10, and press-fitted into back-right-center opening 31 (to the inner surface of hat 10), then press-fitted through and out of back-right opening 33, to extend to an outer surface of hat 10 and provide a length of cord 20 which can be grasped and adjusted or tightened by a wearer.

This press-fitted weave pattern described above, where only one of first and second ends 24 and 28 of cord 20 is woven through each of the four back openings, and the other of first and second ends 24 and 28 of cord 20 is woven through only two of the four back openings provides only one sub-segment of cord 20, designated as 20*c*, extending across the axial midline of hat 10. Therefore, sub-segments of cord 20 are in frictional contact with one another at back openings 21 and 33.

In each of the embodiments illustrated in FIGS. 2A and 2B, cord 20 is in frictional contact with at least two back openings. As such, cord 20 sub-segments and both first end 24 and second end 28 of cord 20 respectively extend beyond said back openings and upon the outward side of the weave layer, thus permitting manual engagement of the first and second end sub-segments 24 and 28, respectively, for purposes of tightening of the hat or article of clothing along said plane of the peripheral surface.

FIG. 3A is a bottom view of the article illustrated in FIG. 2A, showing a partial view of the inner surface of a hat as the wearable article. This view, shown in landscape orientation, provides the front of the hat oriented toward the left side and the back of the hat oriented toward the right side of the page. FIG. 3A illustrates the middle portion of cord 20 as woven into the two front openings 30 and 32 exposing a sub-segment of cord 20 on the inner surface of the hat facing the user when worn.

FIG. 3A further illustrates the position of cord 20 wherein first and second ends 24 and 28 (not shown) are both press-fittingly woven through all four back openings 21, 22, 31, and 33. This configuration exposes cord 20 at two positions on the inner surface of the hat facing the user when worn. Each of these exposed positions include overlapping sub-segments of cord 20. Specifically, sub-segments 23*a* and 23*b* are the sub-segments exposed on the inner surface when first end 24 of cord 20 is press-fitted into opening 22 and out of opening 21, and second end 28 of cord 20 is press-fitted into opening 21 and out of opening 22. Sub-segments 43*a* and 43*b* are the sub-segments exposed on the inner surface when first end 24 of cord 20 is press-fitted into opening 33 and out of opening 31, and second end 28 of cord 20 is press-fitted into opening 31 and out of opening 33. Being press-fittingly woven in this configuration, first end 24 and second end 28 thereby also result in connecting sub-segments of cord 20, upstream from first and second ends 24 and 28, to cross over and frictionally contact one another on the outer surface of the article, in an area between openings 22 and 31 (see 20*c* in FIG. 2B). The fibrous filaments 14 and individual strands 16 of the weave layer of hat 10 are also illustrated in FIG. 3A.

Each of these exposed positions include overlapping sub-segments of cord 20. Specifically, sub-segments 23*a* and 23*b* are the sub-segments exposed on the inner surface when first end 24 of cord 20 is press-fittingly woven into opening 22 and out of opening 21, and second end 28 of cord 20 is press-fitted into opening 21 and out of opening 22. Sub-segments 43*a* and 43*b* are the sub-segments exposed on the inner surface when first end 24 of cord 20 is press-fitted into opening 33 and out of opening 31, and second end 28 of cord 20 is press-fitted into opening 31 and out of opening 33. Being press-fittingly woven in this configuration, first end 24 and second end 28 thereby also result in connecting sub-segments of cord 20, upstream from first and second ends 24 and 28, to cross over and frictionally contact one another on the outer surface of the article, in an area between openings 22 and 31. The fibrous filaments 14 and individual strands 16 of the weave layer of hat 10 are also illustrated in FIG. 3A.

Figure 3B:
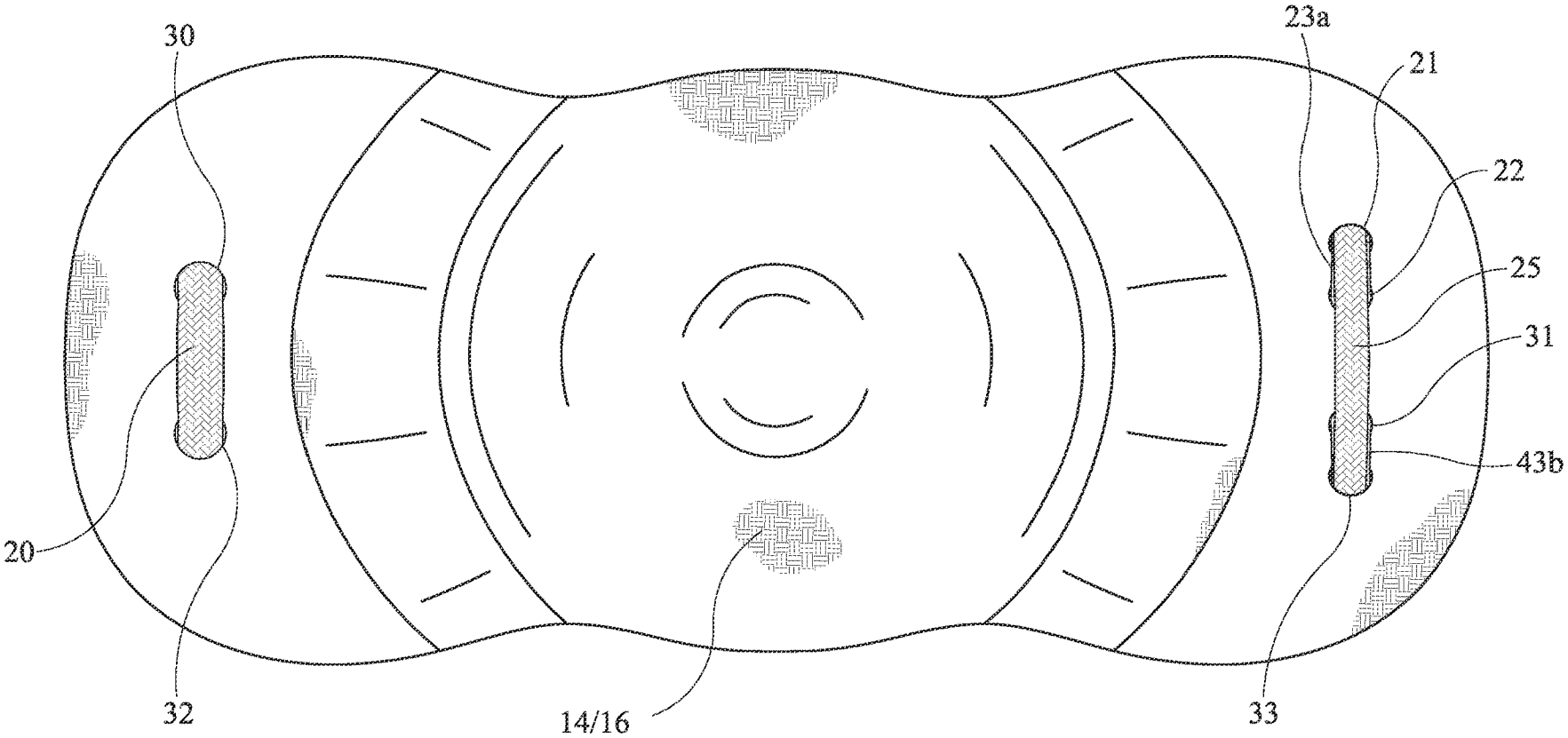
FIG. 3B is a bottom view of the article illustrated in FIG. 2B having one of a first end and second end of the drawstring woven through all four back openings, and the other of a first end and a second end of the drawstring woven through two of the four back openings.

FIG. 3B is a bottom view of the article illustrated in FIG. 2B, showing a partial view of the inner surface of a hat as the wearable article. This view, shown in landscape orientation, provides the front of the hat oriented toward the left side and the back of the hat oriented toward the right side of the page. FIG. 3B illustrates the middle portion of cord 20 as woven into the two front openings 30 and 32 exposing a sub-segment of cord 20 on the inner surface of the hat facing the user when worn.

FIG. 3B further illustrates the position of cord 20 wherein one of the first and second ends 24 and 28 (not shown) is press-fittingly woven through all four back openings 21, 22, 31, and 33, and the other of first and second ends 24 and 28 are woven through only two of the back openings. This configuration exposes one portion of cord 20, upstream from either of first or second ends 24 and 28 as one sub-segment 25 of cord 20 on the inner surface of the hat facing the user when worn. This one sub-segment 25 extends from one of the openings 21 or 22, preferably back-left opening 21, on the left side, to one of the openings 31 or 33, preferably back-right opening 33, on the back right side of the hat. The other of the first or second ends 24 or 28 not press-fittingly woven in this manner is press-fittingly woven through all four back openings 21, 22, 31, and 33, as described for the configuration exposing two sub-segments of cord 20 on the inner surface of hat 10, shown in FIG. 3A. In this configuration, one sub-segment of cord 20 is exposed on the inner face of hat 10, extending between the left and right sides of hat 10, preferably between back opening 21 to back opening 33, and the other sub-segment of cord 20 is exposed on the inner surface of hat 10 as sub-segments 23*a* (between back openings 21 and 22) and 43*b* (between back openings 31 and 33, and is also exposed on the outer surface of hat 10 between back opening 22 and back opening 31.

Each of these configurations illustrated in FIGS. 2A, 2B, 3A, and 3B can increase the number and area of sub-segments of cord 20 that frictionally contact one another, e.g., where they are press-fittingly woven through the same back opening or where they cross over one another between the back openings. This increased frictional contact can advantageously facilitate and provide adjustment and tightening of the cord in a secured position relative to the body for a longer period of time without requiring re-adjustment or re-tightening as frequently as a wearer is required to do when the article is configured in a manner other than described herein.

Figure 4:
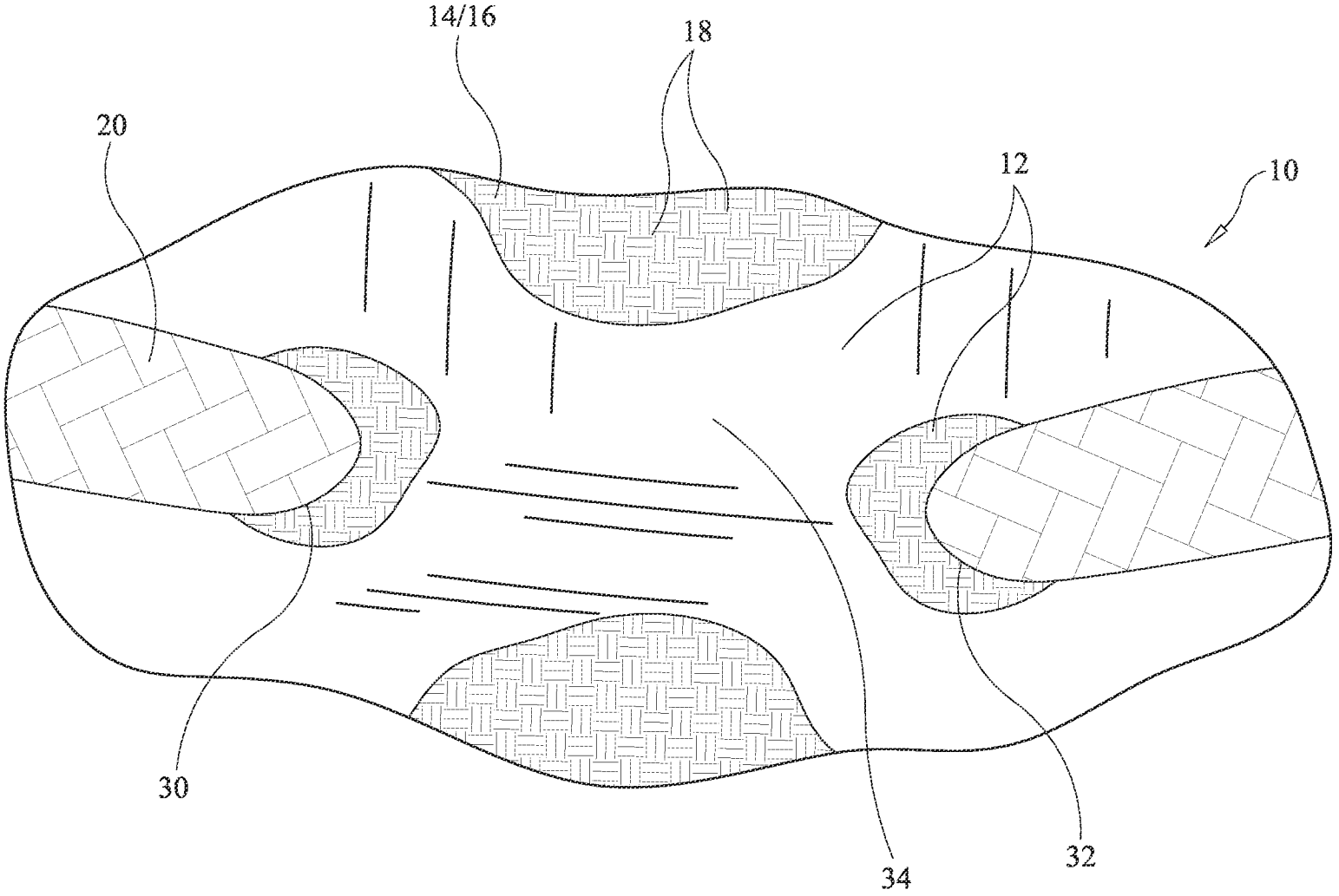
FIG. 4 is a front view of the two front openings of the article.

FIG. 4 is a front view of hat 10, illustrating a close-up view of cord 20, comprising filaments 22, press-fitted into openings 30 and 32 at the front 34 of hat 10. Also illustrated in FIG. 4 is the weave layer 12 forming the body of hat 10, depicting filament 14 comprising individual strands 16, which form a plurality of holes or openings 18 in the material. The depiction in FIG. 4 showing the cord 20 press-fittingly woven into the openings is substantially identical to the manner in which the cord 20 is press-fittingly woven into back openings 21, 22, 31, and 33.

Figure 5:
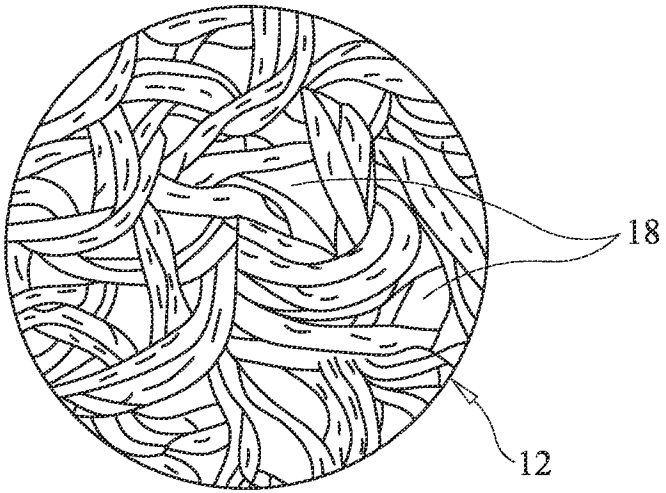
FIG. 5 is an enlarged view of the two front openings formed in a semi-rigid weave layer comprising a plurality of fibrous filaments braided into individual strands.

FIG. 5 is an exploded view of weave layer 12, illustrating the holes or openings 18 formed in the semi-rigid weave layer comprising a plurality of fibrous filaments braided into individual strands.

Figure 6:
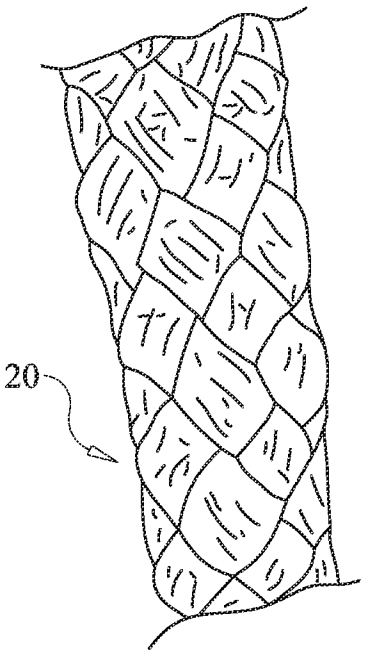
FIG. 6 is an enlarged view of the drawstring or cord, showing its braided configuration.

FIG. 6 is an enlarged view of the cord 20, depicting its braided configuration, as described herein used, useful for adjusting and tightening the article on the body of the wearer.

While the preferred embodiment of the present invention entails the use of a sea-grass material for the braiding of said semi-rigid weave layer and the use of a macrame as the braided filament of the cord or drawstring 20, other material, inclusive of polymeric materials, may be employed as long as the frictional characteristics of the surface of the cord or drawstring relative to the front and back pair of openings is comparable to that of the static friction of sea-grass relative to that of a draw string formed of the macrame fabric. Also, it is desirable that said front and back openings exhibit a diameter in a range of about 3 mm to about 6 mm.

The above disclosure generally describes the present invention and is provided for purposes of illustration and is not intended to limit the scope of the invention. The invention described herein may be practiced in the absence of any element or elements, limitation or limitations which is not specifically disclosed herein. Thus, for example, in each instance herein, any of the terms "comprising," "consisting essentially of," and "consisting of" may be replaced with either of the other two terms. The terms and expressions are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. While there has been shown and described the preferred embodiment of the instant invention it is to be appreciated that the invention may be embodied otherwise than is herein specifically shown and described and that, within said embodiment, certain changes may be made in the form without departing from the underlying ideas or principles of this invention as set forth in the claims appended herewith.

The invention claimed is:

1. A system for tightening an article of clothing or accessory having a front and a back and having a peripheral surface capable of being size-adjusted or tightened onto a body of a wearer, said system comprising:

(a) the article of clothing or accessory comprising a plurality of braided strands of a fibrous material forming a semi-rigid weave layer having pattern of about 3 to about 8 holes or openings per linear inch in all directions such that the holes or openings form between about 15 to about 35 percent of the entire surface of said weave layer; and (b) a braided cord more pliable than said weave layer and comprising a plurality of filaments, said cord having a first end, a second end, and a middle portion adjoining said first and second ends, said cord being press-fittingly woven through two front openings in the weave layer, said two front openings being positioned at the front of said article, about one inch to about two inches apart from one another on a horizontal plane, and on opposing sides of an axial midline forming right and left halves of the article, such that about one inch of the middle portion of the cord is positioned on an inner surface of the weave layer, leaving a remaining length of said cord, including the first and second ends of said cord, positioned outwardly of said weave layer and extending on opposite sides of the article to the back of said article, wherein, the first end of said cord is press-fittingly inserted into and out of four back openings in said weave layer, and the second end of said cord is press-fittingly woven through at least two of said four back openings in said weave layer, said first and second ends being woven through said back openings in opposite directions, whereby the first and second ends of the cord and sub-segments adjoining each of said first and second ends of the cord extend outwardly from the outer surface of the weave layer, said adjoining sub-segments having sufficient length to manually grasp and tighten said cord to secure the article to the body of the wearer, said back openings being positioned substantially along a horizontal plane parallel to said front two openings, whereby one or more sub-segments adjoining the first end of the cord frictionally contact one or more sub-segments adjoining the second end of the cord.

2. The system of claim 1, wherein the article of clothing or accessory is a hat.

3. The system of claim 2, wherein the cord is tightened to secure the article to the head of the wearer.

4. The system of claim 1, wherein the second end of the cord is press-fittingly woven through four back openings.

5. The system of claim 1, in which said weave layer comprises a sea grass.

6. The system of claim 1, in which said cord comprises a macrame fabric.

7. The system of claim 1, in which said plurality of openings in said weave layer repeat from about 3 to about 5 times per linear inch in all directions.

8. The system of claim 1, in which said weave layer comprises a polymeric material.

9. An article of clothing or accessory comprising a) a plurality of braided strands of a fibrous material forming a semi-rigid weave layer having pattern of about 3 to about 8 openings per linear inch in all directions such that the openings form between about 15 to about 35 percent of the entire surface of said weave layer; and (b) a braided cord more pliable than said weave layer and comprising a plurality of filaments, said cord having a first end, a second end, and a middle portion adjoining said first and second ends, said cord being press-fittingly woven through two front openings in the weave layer, said two front openings being positioned at the front of said article, about one inch to about two inches apart from one another on a horizontal plane, and on opposing sides of an axial midline forming right and left halves of the article, such that about one inch of the middle portion of the cord is positioned on an inner surface of the weave layer, leaving a remaining length of said cord, including the first and second ends of said cord, positioned outwardly of said weave layer and extending on opposite sides of the article to the back of said article, wherein, the first end of said cord is press-fittingly inserted into and out of four back openings in said weave layer, and the second end of said cord is press-fittingly woven through at least two of said four back openings in said weave layer, said first and second ends being woven through said back openings in opposite directions, whereby the first and second ends of the cord and sub-segments adjoining each of said first and second ends of the cord extend outwardly from the outer surface of the weave layer, said adjoining sub-segments having sufficient length to manually grasp and tighten said cord to the body of the wearer, said back openings being positioned substantially along a horizontal plane parallel to said front two openings, whereby one or more sub-segments adjoining the first end of the cord frictionally contact one or more sub-segments adjoining the second end of the cord.

10. The article of clothing of claim 9, wherein the article of clothing or accessory is a hat.

11. The hat of claim 10, wherein the cord is tightened to secure the article to the head of the wearer.

12. The article of clothing of claim 9, wherein the second end of the cord is press-fittingly woven through four back openings.

13. The article of clothing of claim 9, in which said weave layer comprises a sea grass.

14. The article of clothing of claim 9, in which said cord comprises a macrame fabric.

15. The article of clothing of claim 9, in which said plurality of openings in said weave layer repeat from about 3 to about 5 times per linear inch in all directions.

16. The article of clothing of claim 9, in which said weave layer comprises a polymeric material.

17. A method for tightening and securing an article of clothing or accessory to a body of a wearer of said clothing, said method comprising:

providing an article of clothing of claim 9;

manually pulling a sub-segment of the cord adjoining a first end of the cord; and concurrently pulling a sub-segment adjoining the second end of the cord to tighten the cord around the body of the wearer; and thereby secure the article to the body of the wearer.

18. The method of claim 17, wherein the article of clothing or accessory is a hat.

19. The method of claim 18, wherein the hat is secured to the head of the wearer.

* * * * *